US006963159B2

(12) United States Patent
Fushimi

(10) Patent No.: US 6,963,159 B2
(45) Date of Patent: Nov. 8, 2005

(54) IMAGE-FORMING APPARATUS AND SPACER

(75) Inventor: Masahiro Fushimi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 10/345,248

(22) Filed: Jan. 16, 2003

(65) Prior Publication Data

US 2003/0141803 A1 Jul. 31, 2003

(30) Foreign Application Priority Data

Jan. 30, 2002 (JP) ..... 2002-021868

(51) Int. Cl.[7] ..... H01J 1/88; H01J 1/62

(52) U.S. Cl. ..... 313/292; 313/495; 313/609; 313/238

(58) Field of Search ..... 313/495–497, 313/292, 609, 610, 582, 587, 238–242, 483

(56) References Cited

U.S. PATENT DOCUMENTS 5,939,822 A * 8/1999 Alderson ..... 313/493
6,222,313 B1 * 4/2001 Smith et al. ..... 313/495
6,353,280 B1 * 3/2002 Shibata et al. ..... 313/292
6,494,757 B2 * 12/2002 Yamazaki et al. ..... 445/24
6,617,772 B1 * 9/2003 Barton et al. ..... 313/292
2002/0031974 A1 3/2002 Ito et al. ..... 445/24
2002/0034916 A1 3/2002 Fushimi et al. ..... 445/24

FOREIGN PATENT DOCUMENTS

JP 2000-311632 11/2000

* cited by examiner

*Primary Examiner*—Ashok Patel
*Assistant Examiner*—German Colón
(74) *Attorney, Agent, or Firm*—Fitzpatrick, Cella, Harper & Scinto

(57) ABSTRACT

An image-forming apparatus includes a first substrate, a second substrate, and a spacer that defines the spacing between the first substrate and the second substrate. The spacer has a portion ruggedized with grooves on the surface thereof exposed in the space between the first substrate and the second substrate. The grooves extend in a striped fashion substantially parallel with the first substrate and the second substrate. The ruggedized portion includes a plurality of regions, which are different from each other, in the ruggedized configuration. The image-forming apparatus thus controls an electron beam with a high accuracy, with no disturbance caused by the spacer.

18 Claims, 14 Drawing Sheets

IMAGE-FORMING APPARATUS AND SPACER

BACKGROUND OF THE INVENTION

1. Field of the Invention

The present invention relates to an electron beam apparatus having an electron source for emitting electrons, and used as an image-forming apparatus, and a spacer for internally supporting an enclosure device arranged in the electron beam apparatus, and more particularly to an electron beam apparatus having a surface-conduction electron emitter device working as an electron source, and a spacer.

2. Description of the Related Art

Two types of electrode emitters, a hot-cathode type electron source and cold-cathode type electron source, are known. The cold-cathode type electron sources include a field emission (FE) device, metal/insulator/metal (MIM) device, surface-conduction electron emitter (SCE) device, etc.

The surface-conduction electron emitter device uses the phenomenon that electrons are emitted if a current flows through the surface of a small-sized, thin film formed on a substrate in a direction parallel with the surface of the thin film. Among such surface-conduction electron emitter devices, there is one device proposed by Elinson employing an $SnO_2$ film, and another device proposed by employing an Au thin film, an $In_2O_3/SnO_2$ thin film, or a carbon thin film.

Since the surface-conduction electron emitter device from among the cold-cathode devices is simple in construction and easy to manufacture, a number of devices can be formed over a wide surface area. The application of the surface-conduction electron emitter device as an image-forming apparatus such as an image display device, or an image recording device, or a charged beam source has been extensively studied.

One application example of the image display apparatus includes a spacer substrate, a faceplate as a second member having a fluorescent material, and a rear plate as a first member having an electron source. The space between the faceplate and the rear plate is maintained in a vacuum.

There is a potential difference between the faceplate and the rear plate with the faceplate set at a potential higher than that of the rear plate. Arranged on the rear plate are an electron emitter that emits electrons, a driving circuit that drives the electron emitter, and wiring electrodes that connect the electron emitter to the driving circuit. When the electron emitter is driven by the wiring electrodes, electrons are emitted from the electron emitter toward the faceplate, and the fluorescent material on the faceplate forms a desired image.

The spacer substrate interposed between the faceplate and the rear plate maintains the gap between the faceplate and the rear plate against the atmospheric pressure. The spacer substrate must have a sufficient mechanical strength to withstand the atmospheric pressure. It is also important to make sure that the spacer substrate does not affect the trajectory of electrons traveling between the rear plate and the faceplate.

The charge accumulated in the spacer substrate greatly affects the trajectory of electrons traveling between the rear plate and the faceplate. Some of the electrons emitted from the electron emitter or electrons reflected off the faceplate enter the spacer substrate, causing secondary electrons to be emitted from the spacer substrate. Also, ions caused as a result of the collision of electrons sticks to the surface of the spacer substrate. As a result, the spacer substrate is charged.

If the spacer substrate is positively charged, electrons flying within a close range therefrom are attracted by the spacer substrate. These electrons are deflected from a trajectory thereof to form a desired image. The resulting image on the faceplate is thus subject to distortion. The attractive force acting on the electrons becomes large as the electrons fly near the spacer substrate. The nearer the electrons are to the spacer substrate, the larger the distortion of the image on the faceplate. In such an image display apparatus, the electron trajectory is deviated more when the electrons reach the faceplate as the spacing between the rear plate and the faceplate is increased. The distortion in the image becomes pronounced.

To control the distortion of the image, an electrode for correcting the electron trajectory is conventionally formed in the spacer substrate, or the spacer substrate is conventionally coated with a resistive film having a high resistance for conduction, thereby allowing a slight current to flow and thereby to remove a charge therefrom.

In another method, spacer electrodes are arranged on the spacer substrate at the contact points thereof with each of the faceplate and the rear plate to apply a uniform electric field to a coating material of the spacer substrate. This arrangement prevents the spacer substrate from being damaged by poor contacts or concentration of current.

As disclosed in Japanese Laid-Open Patent Application No. 2000-311632, the surface of the spacer substrate is ruggedized, and is then coated with a high-resistance material to control the amount of charge in the spacer substrate.

Using the above-mentioned techniques, the conventional electron apparatus controls the electrons traveling close to the spacer from being attracted by the spacer, and corrects the distortion in the image.

A high definition requirement on the image display apparatus is currently mounting, and there is a need for an electron beam apparatus that controls the electron beam with a high accuracy.

SUMMARY OF THE INVENTION

It is an object of the present invention to provide an electron beam apparatus and a spacer for controlling an electron beam with a higher accuracy.

An image-forming apparatus in a first aspect of the present invention includes a first substrate, a second substrate, and a spacer that defines the spacing between the first substrate and the second substrate, wherein the spacer includes a portion ruggedized with grooves on the surface thereof exposed in the space between the first substrate and the second substrate. The grooves extend in a striped fashion in substantial parallel with the first substrate and the second substrate. The ruggedized portion includes a plurality of regions which are different from each other in the ruggedized configuration.

Preferably, the surface is divided into a plurality of regions which are different in at least one of the average pitch of the grooves and the average depth of the grooves.

In the image-forming apparatus of the present invention, the spacer includes the ruggedized portion having the grooves extending in substantial parallel with the first substrate and the second substrate. The ruggedized portion includes a plurality of regions different in the ruggedized configuration. In this way, the charged state on the surface of the spacer becomes different from region to region. The trajectory of the electron beam is controlled as desired and is thus free from disturbance.

Generally, a ruggedized substrate coated with a resistive film has a larger resistance than a flat substrate (a substrate having a flat surface) coated with the same resistive film. This is because the ruggedized substrate has a longer length of the resistive film per unit length. The inventors of this invention have found that a combination of a particular material for the resistive film and a manufacturing method of the spacer increases a change in resistance on the ruggedized substrate.

The material is a nitrogen compound of tungsten (W) and germanium (Ge).

FIG. 1 is a plot of a change in sheet resistance versus a groove depth wherein the sheet resistance of the film is controlled using a sputtering technique. FIG. 2 is a plot of a change in sheet resistance versus the pitch of grooves. Referring to FIG. 1, the sheet resistance increases as the groove depth increases. Referring to FIG. 2, the sheet resistance decreases as the groove pitch becomes longer. The high-resistance resistive film is formed using tungsten (W) and germanium (Ge) as a target in a mixture gas containing argon (Ar) and nitrogen ($N_2$) at a flow rate of argon to nitrogen of 10:1 at a sputtering pressure of 1.0 Pa. The substrate is spaced from the targets by about 100 mm, an input power to the tungsten target is 0.6 W/cm$^2$, and an input power to the germanium target is 2 W/cm$^2$. A resulting thickness of the film is 200 nm.

By appropriately changing the depth of the grooves or the pitch of the grooves from surface region to surface region, a spacer having a desired resistance distribution is formed in a direction in a spacing between a second substrate (a faceplate) and a first substrate (a rear plate). The trajectory of the electron beam is corrected to a desired location by adjusting the resistance distribution on the surface of the space.

A desired potential distribution is formed by using a region having no ruggedness. The region having no ruggedness is thus free from the pitch, depth, and number of the grooves. The purpose of the present invention is achieved by incorporating a combination of ruggedized portions. The potential distribution depends on the spacer, the construction of panels, driving conditions, etc., and is not determined by any single factor. The inventors of this invention have found that the electrons are repelled from the spacer or attracted to the spacer by charge under the following conditions.

(1) The average pitch of the grooves formed on the spacer from a half-way point up to the faceplate is smaller than the average pitch of the grooves formed on the spacer from the half-way point down to the rear plate.

(2) The average depth of the grooves formed on the spacer from the half-way point up to the faceplate is larger than the average depth of the grooves formed on the spacer from the half-way point down to the rear plate.

(3) The number of the grooves formed on the spacer from the half-way point up to the faceplate is greater than the number of the grooves formed on the spacer from the half-way point down to the rear plate.

It is important that the grooves of the spacer on the faceplate side be smaller in pitch, deeper in depth, or larger in number than the grooves of the spacer on the rear plate side. The segmentation position (border) of the regions is not necessarily at the half-way point of the spacer. It suffices to satisfy the above requirement, if compared with respect to the half-way point.

The spacer of the present invention having the ruggedized configuration may be produced using any technique. For example, the spacer may be produced from a material, which is softened with heat, using a molding technique, or may be produced by cutting a material. In particular, glass may be cut or molded into a ruggedized configuration, and extended in the vicinity of or above the softening point thereof. This method is excellent from the standpoint of bulk production. The spacer of the present invention may have no ruggedness on a portion thereof to facilitate bulk production.

In accordance with the present invention, the substantially entire surface of the spacer extending between the faceplate and the rear plate is ruggedized to control charge accumulation. The electrode function of the ruggedized portion allows the electron beam to be easily corrected in trajectory. A quality image is thus presented.

Further objects, features, and advantages of the present invention will be apparent from the following description of the preferred embodiments with reference to the attached drawings.

DESCRIPTION OF THE PREFERRED EMBODIMENTS

An electron beam apparatus and a spacer thereof in accordance with one embodiment of the present invention will now be discussed in detail with reference to the drawings. The following discussion focuses on the construction, the operation and the manufacturing method of the image display apparatus, which is one application of the electron beam apparatus of the present invention.

Figure 4:
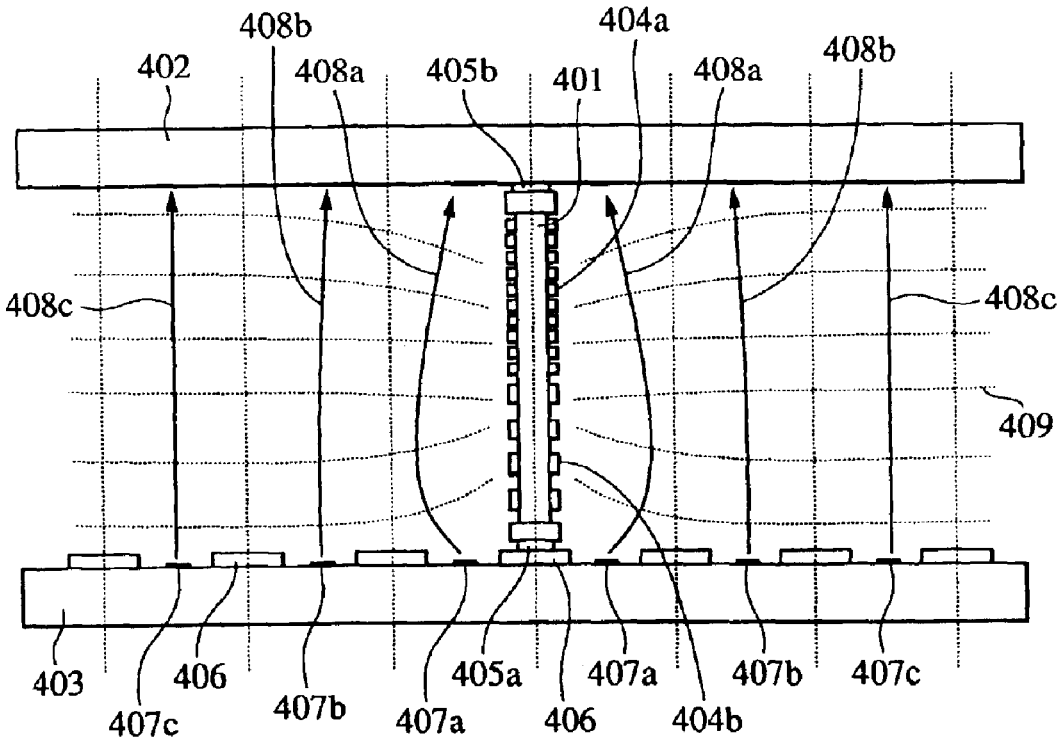
FIG. 4 is a sectional view of the construction of the image display apparatus of the embodiment of the present invention.

FIG. 4 is a sectional view of the construction of the image display apparatus of one embodiment of the present invention. As shown, the image display apparatus of the present invention includes a faceplate 402 working as a second substrate, and a rear plate 403 working as a first substrate. The space between the faceplate 402 and the rear plate 403 becomes an internal space in an air-tight container (not shown), and is kept in vacuum by the air-tight container, namely, an enclosure unit.

A thin spacer is fixed between the faceplate 402 and the rear plate 403 to maintain the spacing between the faceplate 402 and the rear plate 403 against the force of the atmospheric pressure. A single spacer is shown in FIG. 4, but in practice, the required number of spacers may be arranged with required intervals to achieve the above object (to maintain the required spacing between the faceplate 402 and the rear plate 403). A dielectric component 401 as the spacer substrate is coated with high-resistance resistive films 404*a* and 404*b* to prevent static charge accumulation. The high-resistance resistive film 404*a* is deposited in a region a, and the high-resistance resistive film 404*b* is deposited in a region b. The spacer is also coated with a spacer electrode 405*b* to be in contact with the faceplate 402, and with a spacer electrode 405*a* to be in contact with the rear plate 403.

The high-resistance resistive films 404*a* and 404*b* are deposited on at least the surface of the dielectric component 401 exposed to the vacuum in the air-tight container, and are electrically connected to the metal back (not shown) formed on the internal surface of the faceplate 402 and a wiring electrode 406 on the surface of the rear plate 403 respectively through the spacer electrodes 405*b* and 405*a*. The spacer must have insulation high enough to withstand a high voltage applied between the wiring electrode 406 on the rear plate 403 and the metal back on the faceplate 402 and conductivity enough to prevent static charge accumulation on the surface of the spacer. Such a dielectric component 401 of the spacer may be formed of quartz glass, glass having no or reduced impurity content such as sodium (Na), soda-lime glass, or ceramic such as alumina. The dielectric component 401 has preferably a coefficient of thermal expansion close to that of the air-tight container or the rear plate 403.

A current flows through the high-resistance resistive films 404*a* and 404*b*. The current is determined by dividing an acceleration voltage Va applied to the faceplate 402 at a high voltage side by the sum Rs of resistances of the high-resistance resistive films 404*a* and 404*b* as an anti-static film. The sum Rs of resistances of the high-resistance resistive films 404*a* and 404*b* is determined from the standpoint of preventing static charge accumulation and saving power. From the standpoint of preventing the static charge accumulation, the surface resistance R/square of each of the high-resistance resistive films 404*a* and 404*b* is preferably $10^{14}$ Ω or less. More preferably, the surface resistance R/square of the high-resistance resistive films 404*a* and 404*b* is preferably $10^{13}$ Ω or less. The lower limit of the surface resistance R/square of the high-resistance resistive films 404*a* and 404*b* is preferably $10^{7}$ Ω or more, although the lower limit depends on the configuration of the spacer and the voltage applied to the spacer.

The thickness t of the high-resistance (anti-static) films 404*a* and 404*b* preferably falls within a range of 10 nm to 50 μm. The thin film is formed in an island if the film is thinned to less than 10 nm, and the resistance thereof becomes unstable and lacks repeatability, although these depend on the surface energy of the film, the bond of the film with the substrate, and the temperature of the substrate. If the thickness of the film is set to be 50 μm or more, the dielectric component 401 is likely to be deformed.

Let ρ represent a specific resistance of the high-resistance resistive films 404*a* and 404*b*, and the surface resistance R/square is ρ/t. From the above-mentioned preferable ranges of R/square and t, the specific resistance ρ of the high-resistance resistive films 404*a* and 404*b* preferably falls within a range of $10^{4}$ Ω·cm to $10^{10}$ Ω·cm. From the above-mentioned more preferable ranges of R/square and t, the specific resistance ρ of the high-resistance resistive films 404*a* and 404*b* more preferably falls within a range of $10^{5}$ Ω·cm to $10^{9}$ Ω·cm.

When a current flows through the high-resistance resistive films 404*a* and 404*b*, or when the entire image display apparatus generates heat, the spacer rises in temperature. If the temperature coefficient of the high-resistance resistive films 404*a* and 404*b* is a large negative value, the resistance thereof drops with a temperature rise, and the current flowing through the films increases. The spacer further rises in temperature. The current then continuously increases to a current runaway in excess of a limit of the power supply. The condition under which the current runaway occurs is generally characterized by TCR (Temperature Coefficient of Resistance) of a resistor expressed by equation (1).

$$TCR=(\Delta R/\Delta T)/R\times 100\ [\%/^{\circ}\ \mathrm{C.}] \quad (1)$$

where ΔT represents an increase in the temperature spacer with respect to room temperature, and ΔR represents an increase in the resistance of the resistor during actual operating conditions.

Experience shows that the condition of TCR under which the current runaway occurs is −1%/° C. or lower. Specifically, the temperature coefficient of the high-resistance resistive films 404*a* and 404*b* is preferably set to be greater than −1 [%/° C.].

The high-resistance resistive films 404*a* and 404*b* having an anti-static property are preferably fabricated of a metal oxide. Among the metal oxides, the metal oxide of one of chromium (Cr), Nickel (Ni), and copper (Cu) is preferable. This is because a relatively small secondary emission efficiency of these compounds makes it less possible for the spacer to be charged when electrons emitted from the electron emitters 407*a*, 407*b*, and 407*c* collide with the spacer. Besides the metal oxides, carbon is preferred as a material for the high-resistance resistive films 404*a* and 404*b* because of the smaller secondary electron emission efficiency thereof. In particular, amorphous carbon has a high resistance. If amorphous carbon is used for the high-resistance resistive films 404*a* and 404*b*, the resistance of the spacer is easily controlled to a desired value.

The nitride of aluminum and a transition-metal compound is used for the high-resistance resistive films 404*a* and 404*b* having an anti-static property. Since the nitride of aluminum and the transition-metal compound is controlled in a wide resistance range from an electrically conductive state to a dielectric state, the nitride of aluminum and the transition-metal compound is preferable. Furthermore, the nitride of aluminum and the transition-metal compound is stable, and suffers less variations in resistance in a manufacturing process of the display apparatus to be discussed later. The temperature coefficient thereof is higher than −1 [%/° C.], and is easy to use. The transition-metal element may be titanium (Ti), chromium (Cr), tantalum (Ta), etc.

A nitride film is deposited on the dielectric component 401 as the high-resistance resistive films 404*a* and 404*b* using a thin film formation technique such as sputtering, reactive sputtering in a nitrogen gas atmosphere, electron-beam deposition, ion plating, or ion-assist deposition. A metal oxide film may be equally formed for the high-resistance resistive films 404*a* and 404*b* using the same thin film formation technique. In this case, however, an oxygen gas rather than a nitrogen gas is used as an atmosphere. Furthermore, a metal oxide film is formed for the high-resistance resistive films 404*a* and 404*b* using a CVD method, alcoxide application method, etc.

A carbon film is formed using deposition, sputtering, CVD method, or plasma CVD. Particularly when the high-resistance resistive films 404*a* and 404*b* are fabricated of amorphous carbon, hydrogen is contained in an atmosphere during film formation or hydrocarbon is used as a film forming gas.

The spacer electrodes 405*b* and 405*a* forming the spacer are arranged to electrically connect the high-resistance resistive films 404*a* and 404*b* to the faceplate 402 at a high voltage side and the rear plate 403 at a low voltage side. The spacer electrodes 405*a* and 405*b* have a plurality of functions as discussed below.

The high-resistance resistive films 404*a* and 404*b* serve the anti-static purpose on the surface of the spacer. If the high-resistance resistive films 404*a* and 404*b* are directly and respectively connected to the faceplate 402 and the rear plate 403 without using the spacer electrodes 405*a* and 405*b*, a large contact resistance occurs at the interface therebetween. The large contact resistance makes it difficult for a charge generated on the surface of the spacer to be quickly removed. To avoid this, the spacer electrodes 405*a* and 405*b* are arranged on the abutment faces of the spacer with the faceplate 402 and the rear plate 403.

Electrons emitted from electron emitters 407*a*, 407*b*, and 407*c* move along trajectories 408*a*, 408*b* and 408*c* in accordance with a potential distribution formed between the faceplate 402 and the rear plate 403. The potential distribution on the high-resistance resistive films 404*a* and 404*b* must be controlled over the entire extension thereof to keep the electron trajectories 408*a*, 408*b* and 408*c* from disturbance in the vicinity of the spacer. If the high-resistance resistive films 404*a* and 404*b* are connected to the faceplate 402 and the rear plate 403, non-uniformity in the connection state of the films and the plates occurs due to a contact resistance at the interface between the films and the plates. As a result, the potential distribution of the high-resistance resistive films 404*a* and 404*b* may be deviated from a desired one. To avoid this, the entire end faces of the spacer to be in contact with the faceplate 402 and the rear plate 403 are provided with the spacer electrodes 405*b* and 405*a*, respectively. This arrangement controls the non-uniformity in the connection state of the spacer, thereby making the potential distribution of the high-resistance resistive films 404*b* and 404*a* uniform.

Electrons emitted from the electron emitters 407*a*, 407*b* and 407*c* form the electron trajectories in accordance with the potential distribution generated between the faceplate 402 and the rear plate 403. Electrons emitted from the electron emitter 407*a* close to the spacer are subject to effect of the spacer (wiring and the position of the device). To present an image free from distortion and non-uniformity, the trajectory of emitted electrons is controlled to land the electrons in a desired position on the faceplate 402. By arranging the spacer electrodes 405*b* and 405*a* on the end faces of the spacer to be in contact with the faceplate 402 and the rear plate 403, the potential distribution in the vicinity of the spacer has the desired characteristics and the trajectory of the emitted electrons is controlled.

The ruggedized portion of the spacer extends in stripes in parallel with the faceplate 402 and the rear plate 403 (namely, perpendicular to the page of FIG. 4). The ruggedized portion of the spacer is divided into a plurality of regions having grooves which are different in average pitch and average depth thereof from region to region. In this way, equipotential lines 409 are uniformly distributed in the space between the faceplate 402 and the rear plate 403, thereby preventing the electron trajectory from being disturbed.

The construction and the manufacturing method of the image display apparatus of the present invention are discussed below.

Figure 5:
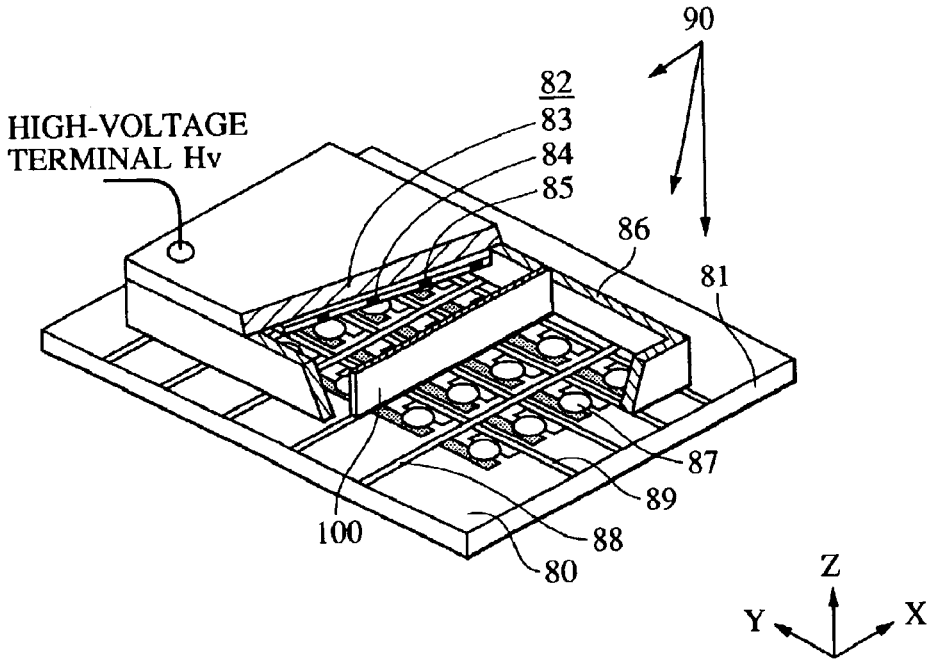
FIG. 5 is a perspective view of the construction of the image display apparatus of the embodiment of the present invention.

FIG. 5 is a perspective view of the construction of the image display apparatus of the embodiment of the present invention. As shown, an electron source substrate 80 includes a number of electron emitter devices 87 arranged thereon. A glass substrate 81 is the rear plate 403 shown in FIG. 4. A faceplate 82 is formed by depositing a fluorescent film 84 and a metal back 85 on the internal surface of a glass substrate 83.

A support frame 86 supports the glass substrate (rear plate) 81 and the faceplate 82. The support frame 86, the glass substrate (rear plate) 81, and the faceplate 82 are bonded together using frit glass, and are calcined for encapsulation at a temperature within a range of 400 to 500° C. for 10 minutes. An enclosure unit 90 thus results. The enclosure unit 90 needs to be kept in vacuum. If the above series of steps of forming the enclosure unit 90 are performed in a vacuum chamber, the enclosure unit 90 is maintained in a vacuum from the beginning. The manufacturing process is thus simplified. In the image display apparatus of the embodiment, the internal space of the enclosure unit 90 is encapsulated from the outside. Referring to FIG. 5, the support frame 86, and the faceplate 82 forming the enclosure unit 90 are appropriately cut to expose the internal structure of the enclosure unit 90 in view.

The electron emitter device 87 is a surface-conduction-type electron emitter device. An X line 88, extending in the X direction, is connected to one of a pair of electrodes of the electron emitter device 87, and a Y line Y 89, extending in the Y direction, is connected to the other of the pair of electrodes of the electron emitter device 87 not connected to the X line 88.

By arranging the spacer 100 (a support assembly) between the faceplate 82 and the glass substrate (rear plate) 81, even a large enclosure unit 90 has a sufficient strength against the atmospheric pressure.

The construction and the manufacturing process of each component of the image display apparatus of the embodiment are discussed below.

Figure 6:
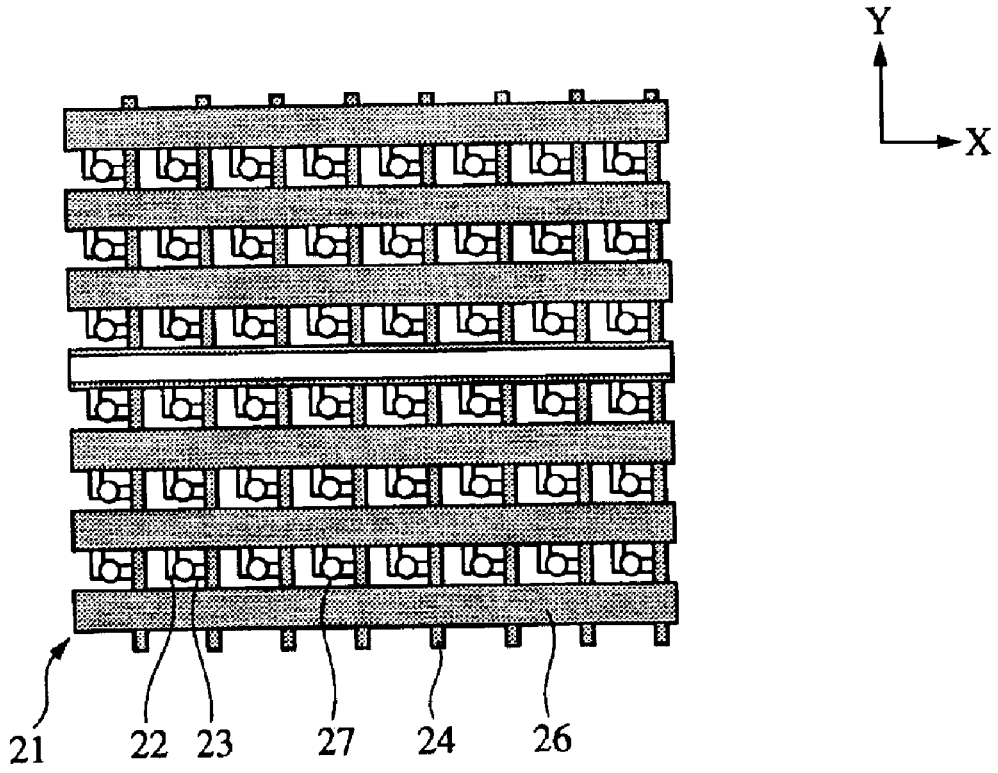
FIG. 6 is a top view of a rear plate (glass substrate) having a matrix of electron emitter devices.

FIG. 6 is a top view of the rear plate (glass substrate) 21 having a matrix of electron emitter elements. Arranged on the electron source substrate (rear plate) 21 are device electrodes 22 and 23, Y lines 24, insulator film 25 (not shown), X lines 26, and electron emitters 27 as a surface-conduction type electron emitter film. The manufacturing method of these components will now be discussed.

First, titanium (Ti) is deposited as an underlayer (to a thickness of 5 nm) on an electron source substrate 21, and platinum (Pt) is then deposited (to a thickness of 40 nm) on the titanium layer using a sputtering technique. A photoresist is applied, and then a series of photolithographic steps including exposure, development, and etching steps is performed to form the device electrodes 22 and 23.

After forming the device electrodes 22 and 23, Y lines 24 (lower lines), as a common wiring, are connected to one of the device electrodes 22 and 23 so that the devices are commonly connected. The material of the Y lines 24 is a silver (Ag) photo-paste ink. The silver photo-paste ink is screen-printed, dried, and then subjected to exposure and development steps, thereby becoming a predetermined pattern. The Y lines 24 are then calcined at a temperature about 480° C. The Y line 24 is about 10 μm thick and about 50 μm wide. The terminal of each Y line 24 has a wide portion at the end thereof to be used as a lead.

To isolate the upper and lower lines (X lines 26 and Y lines 24), an interlayer insulator (not shown) is arranged. The upper lines 26 (the X lines) must be electrically connected to the other of the device electrodes 22 and 23 (namely, the electrode not connected to the Y lines 24). A contact hole (not shown) is drilled in the interlayer insulator at a connection point namely, an intersection of the X line 26 and the Y line 24 beneath the X line 26. In the formation step of the interlayer insulator, photosensitive glass paste having lead oxide (PbO) as the major constituent thereof is screen-printed, and subjected to exposure and development steps. These series of steps are repeated four times. The interlayer insulator is then calcined at a temperature of about 480° C. The thickness of the interlayer insulator is about 30 μm thick, and about 150 μm wide.

A silver paste ink is screen-printed on the interlayer insulator, and is dried. These steps are repeated again for dual coating. The silver paste ink layer is then calcined at a temperature of about 480° C., thereby becoming the X (upper) lines 26. In this arrangement, the X line 26 intersects the Y line 24 with the interlayer insulator sandwiched therebetween, and is connected to the other of the device electrodes 22 and 23 through the contact hole. In a resulting panel structure of the image display device, the device electrodes 22 and 23 work as scanning electrodes. The X line 26 is about 20 μm thick. The electron source substrate 21 needs lead lines which are connected to an external driver. The lead lines are also formed in steps similar to those described above. Furthermore, terminals (not shown) to be connected to the external driver are also produced in steps similar to those described above. The electron source substrate 21 having XY matrix wiring shown in FIG. 6 is produced.

Subsequent to the above-described process, the electron source substrate 21 is sufficiently cleaned. The surface of the electron source substrate 21 is then processed using a solution containing a water repellent material so that the surface of the electron source substrate 21 becomes hydrophobic. This process is performed to appropriately spread a film forming solution to be applied later over the device electrodes 22 and 23.

The method of forming the electron emitter device (device film) is discussed below. After producing the electron source substrate (rear plate) 21 having the above-described XY matrix wiring, an electron emitter device (device film) is formed between the device electrodes 22 and 23 using an ink-jet application method.

Figure 7A:
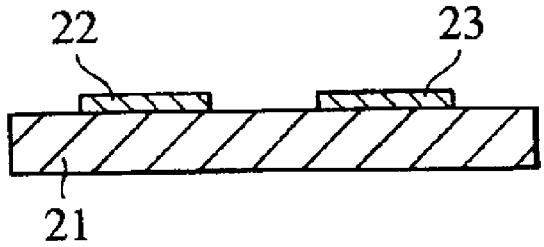
FIGS. 7A–7C diagrammatically illustrate the manufacturing process of a device film.
Figure 7B:
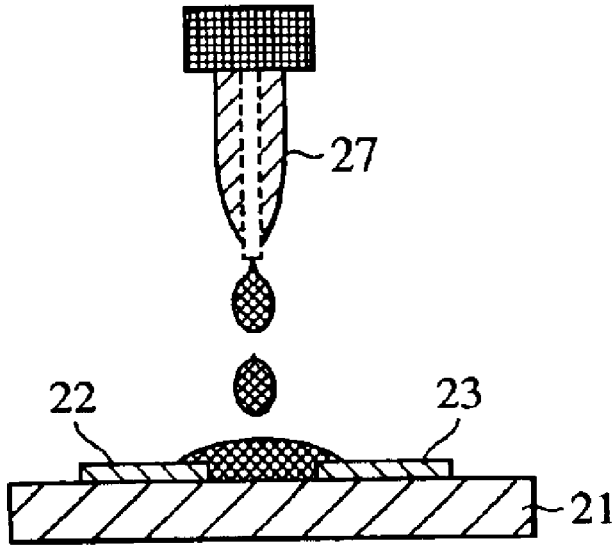
Figure 7C:
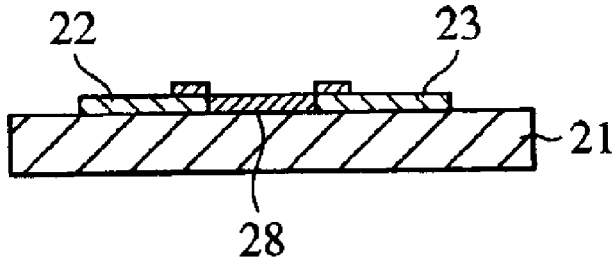

FIGS. 7A–7C diagrammatically illustrate the device film 28. Referring to FIG. 7A, the electron source substrate 21 has the device electrodes 22 and 23 thereon subsequent to the above-referenced steps. In this process, a palladium (Pd) film straddling the device electrodes 22 and 23 is formed as the device film 28.

A palladium oxide (PdO) film is thus formed between the device electrodes 22 and 23 through the above process.

Subsequent to the formation of the device film 28, an electron emitter 27 (shown in FIG. 7B) is formed on the device film 28 in a forming process. In this process, a voltage is applied to the electrically conductive thin film (the device film 28) to cause a crack within the device film 28. The electron emitter 27 is thus produced.

Figure 8A:
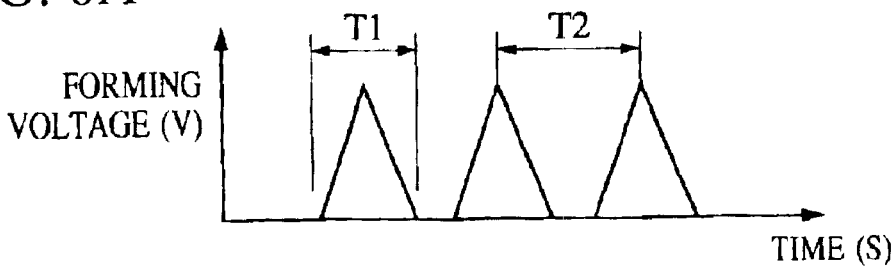
FIGS. 8A and 8B are graphs illustrating a forming voltage and time in a forming process.
Figure 8B:
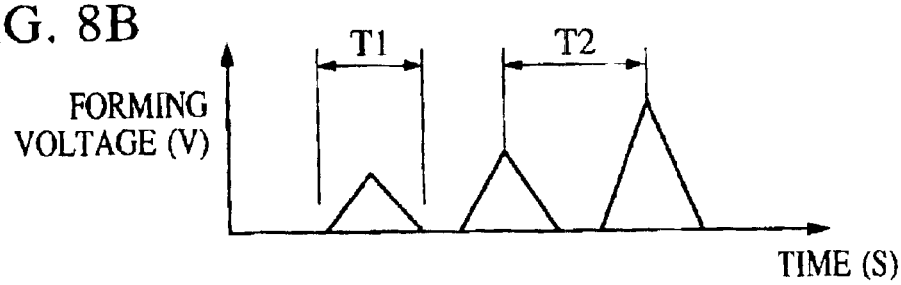
Figure 9A:
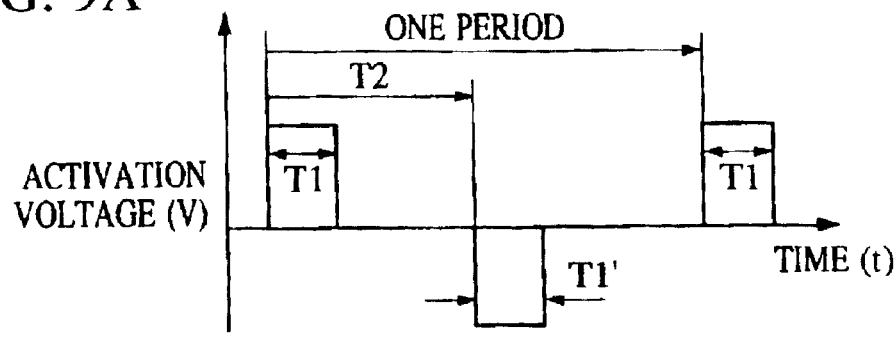
FIGS. 9A and 9B are graphs illustrating an activation voltage and time in an activation process.
Figure 9B:
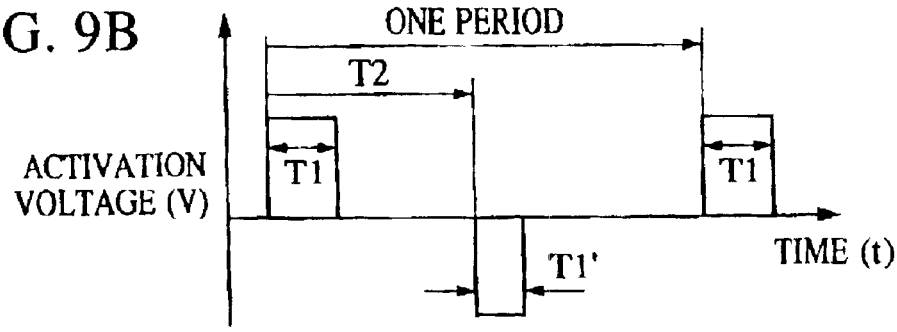

The waveform of the voltage used in the forming process is briefly discussed. FIGS. 8A and 8B are graphs illustrating the forming voltage and time in the forming process. The abscissa represents time, while the ordinate represents the magnitude of the applied forming voltage. Referring to FIGS. 9A and 9B, the forming voltage applied to the device is a pulse voltage, and two methods of applying the voltage are available. Referring to FIG. 8A, the pulse having a constant peak value is applied. Referring to FIG. 8B, the pulse is applied while the peak value thereof is increased at the same time.

Referring to FIG. 8A, T1 and T2 respectively represent the pulse width and the pulse interval of the voltage waveform. In this embodiment, T1 falls within a range of from 1 μm to 10 ms, and T2 falls within a range of from 10 μm to 100 ms. The pulse height (the peak voltage value during the forming process) of each pulse (triangular wave) is appropriately set. Referring to FIG. 8B, T1 and T2 remain unchanged from those shown in FIG. 8A, and the pulse height of the triangular wave (the peak voltage during the forming process) is increased in steps of 0.1 V.

Figure 10:
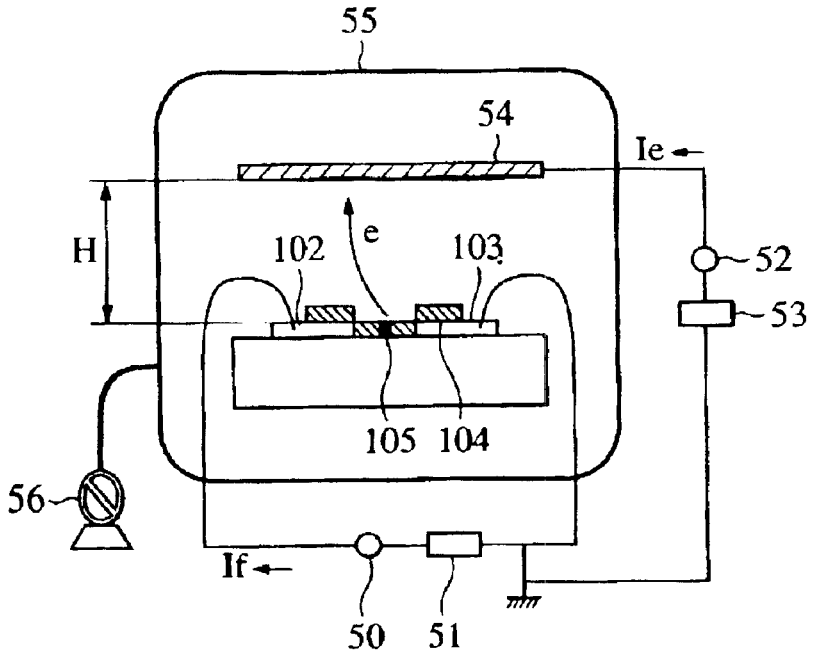
FIG. 10 diagrammatically illustrates the construction of a test instrument which tests electron emission characteristics of the electron emitter device.

Subsequent to the forming process, the electron emitter is formed on the electrically conductive thin film 104 (shown in FIG. 10). In this state, however, the electron emission efficiency of the electron emitter is extremely low. To enhance the electron emission efficiency, the electrically conductive thin film must be subjected to a process called an activation process subsequent to the forming process.

The activation process requires an appropriate level of vacuum with an organic compound present. As in the forming process, the entire electron source substrate 21 (shown in FIGS. 7A–7C) is covered with a hood to fill the space enclosed by the hood and the electron source substrate 21 with vacuum. A pulse voltage (an activation voltage) is repeatedly applied to the device electrodes through the X line 26 and the Y line 24 (shown in FIG. 6). A gas containing carbon atoms is introduced into the vacuum space. Carbon or carbon compound derived from the gas is deposited in the vicinity of the crack in the above-described electron emitter. In this process, tolunitrile is used as a carbon source. A carbon compound is introduced into the vacuum through a slow leak valve while a vacuum level of $1.3\times10^{-4}$ Pa is maintained. Tolunitrile is introduced preferably at a pressure within a range of from $1\times10^{-3}$ Pa to $1\times10^{-5}$ Pa, although the preferred range is subject to change depending on the shape of a vacuum apparatus and instruments used in the device.

FIGS. 9A and 9B are graphs illustrating the activation voltage and time in the activation process.

The device and the basic characteristics of the device produced in accordance with the manufacturing method are discussed with reference to FIGS. 10 and 11.

FIG. 10 diagrammatically illustrates the construction of a test instrument which tests electron emission characteristics of the electron emitter device. As shown, the test instrument includes a vacuum container 55. A vacuum pump 56 evacuates air from within the vacuum container 55. The device produced in the preceding step is placed in the vacuum container 55 in the test instrument to be tested. As already discussed, the device includes the device electrodes 102 and 103, the thin film 104, and the electron emitter 105 in the thin film 104.

The test instrument further includes a power supply 51 and a current meter 50. The power supply 51, connected between the device electrodes 102 and 103, measures a device voltage Vf between the device electrodes 102 and 103. The positive side of the power supply 51 is connected to the device electrode 102, and the negative side of the power supply 51 is connected to the device electrode 103 while being grounded at the same time. The current meter 50, also arranged between the device electrodes 102 and 103, measures a device current If flowing through the electrically conductive thin film 104 including the electron emitter 105.

An electrode 54 is arranged inside the vacuum container 55 at a location facing the electron emitter 105 of the device. The electrode 54 is an anode which captures electrons emitted from the electron emitter 105. The positive side of a high-voltage power supply 52 is connected to the electrode 54. The negative side of the power supply 52 is connected to ground through a current meter 53 which measures an emission current Ie from the electron emitter 105 in the device.

The vacuum container 55 further includes tools required in a typical vacuum apparatus such as a vacuum meter. The electron emitter device is thus tested under a predetermined vacuum condition. In practice, the anode 54 is supplied with a voltage of 1 kV–10 kV, and a distance between the anode 54 and the electron emitter 105 is set to be 1 mm to 8 mm.

Figure 11:
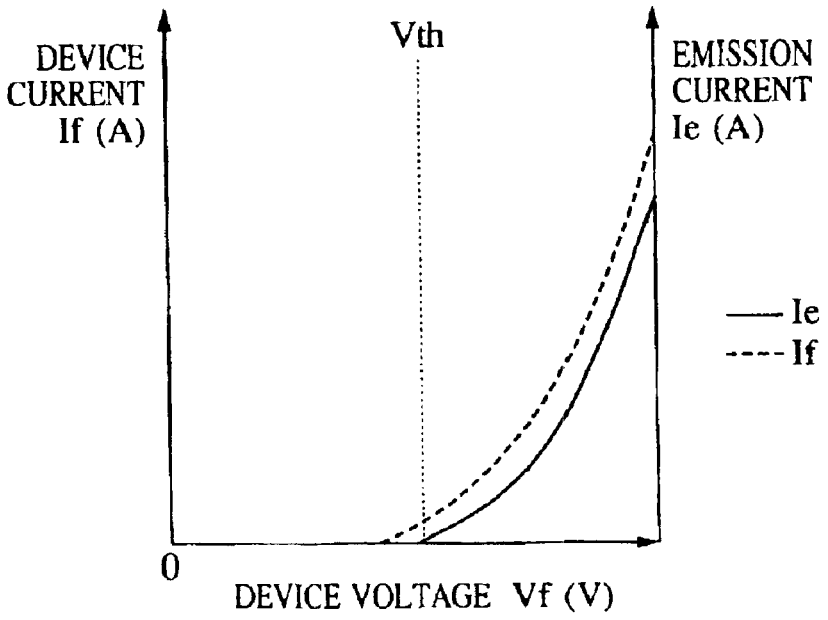
FIG. 11 is a plot of an emission current Ie and device current If versus a device voltage Vf measured by the test instrument of FIG. 10.

FIG. 11 is a plot of the emission current Ie and device current If versus the device voltage Vf measured by the test instrument of FIG. 10. The emission current Ie and the device current If are substantially different from each other with respect to the same device voltage value Vf. To compare variations in characteristics of the device current If and the emission current Ie, the emission current Ie and the device current If have different scales in the ordinate in FIG. 11. As shown, both the device current If and the emission current Ie increase as the device voltage Vf increases.

The construction and the manufacturing method of the faceplate in the image-forming apparatus will now be discussed below.

Figure 12A:
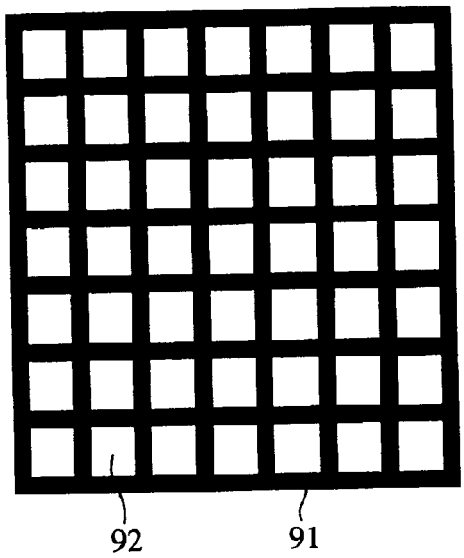
FIGS. 12A and 12B are front views of a faceplate.
Figure 12B:
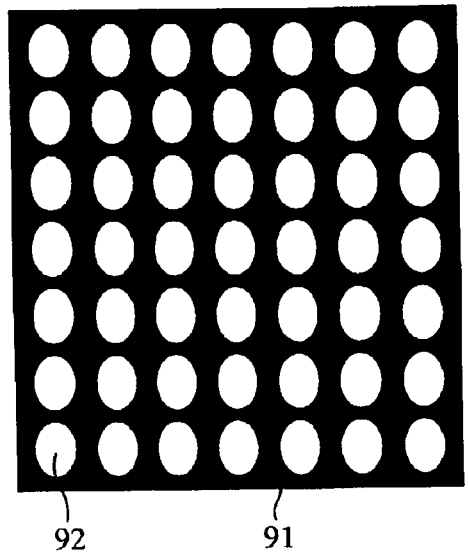

FIGS. 12A and 12B are front views of the faceplate. If the fluorescent film 84 (see FIG. 5) is a monochrome film, the fluorescent film 84 is a fluorescent film only. If the fluorescent film 84 is a color film, the fluorescent film 84 is fabricated of a black conductor 91 called a black stripe or a black matrix and a fluorescent material 92.

In the encapsulation of the enclosure unit 90, the color fluorescent material 92 of each color must correspond to a respective electron emitter device. An abutment method for abutting the upper and lower plates (the rear plate and the faceplate) need to be performed to correctly align the upper and lower plates in position.

The level of vacuum of the enclosure unit 90 subsequent to the encapsulation is $10^{-5}$ Torr. To maintain this level of vacuum subsequent to the encapsulation of the enclosure unit 90, a getter process may be performed. In the getter process, a getter material mounted at a predetermined position (not shown) within the enclosure unit 90 is heated using resistance heating or high-frequency induction heating subsequent to or immediately prior to the encapsulation of the enclosure unit 90. A deposition film is thus formed. The getter typically contains barium (Ba) as the major constituent thereof. The absorption effect of the deposition film maintains the level of vacuum to within a range of $1\times10^{-5}$ Torr to $1\times10^{-7}$ Torr.

According to the basic characteristics of the surface-conduction type electron emitter device of this embodiment, the electrons emitted from the electron emitter are controlled by the peak value and pulse width of the pulse voltage applied between the pair of facing electrodes above a threshold voltage thereof. The intermediate value of the pulse voltage controls the current, and an intermediate gradation display is thus presented.

In the image display apparatus of this embodiment having a matrix of electron emitter devices, a line (one of the X lines) is selected by a scanning line signal and the pulse voltage is applied to each device through an information signal line (one of the Y lines). Each device, supplied with an appropriate voltage, is thus turned on. A voltage modulation or a pulse-width modulation is available as a method for modulating the electron emitter device in response to an input signal having an intermediate gradation level.

Figure 13:
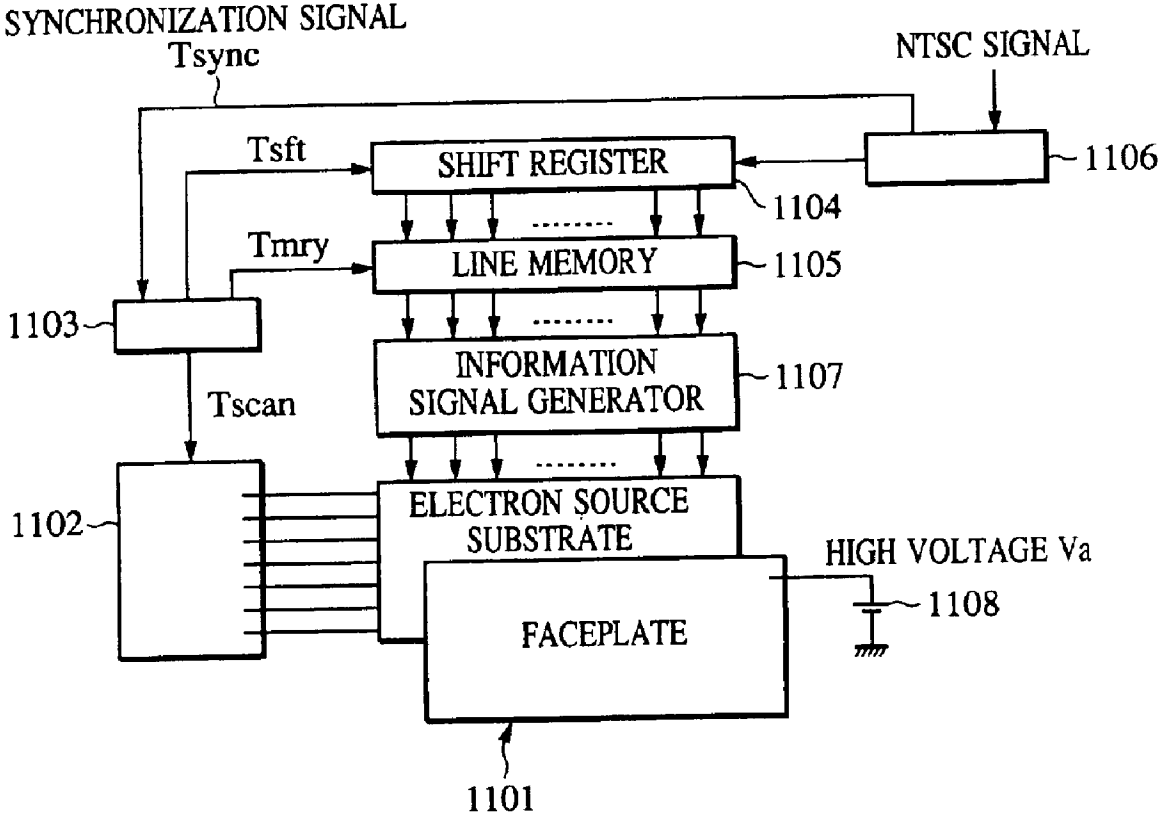
FIG. 13 is a block diagram of a driver for driving the electron emitter device in the image display apparatus of the embodiment of the present invention.

FIG. 13 is a block diagram of a driver for driving the electron emitter device in the image display apparatus of the embodiment of the present invention. The driver is used in a television image display apparatus that uses a panel formed of a passive-matrix electron source and presents an NTSC television signal (video signal).

Referring to FIG. 13, the driver includes an image display panel (a faceplate) 1101, scanning circuit 1102, control circuit 1103, shift register 1104, line memory 1105, synchronization signal separator 1106, information signal generator 1107, and direct-current power supply 1108 for supplying a high voltage Va.

EXAMPLE 1

Figure 3:
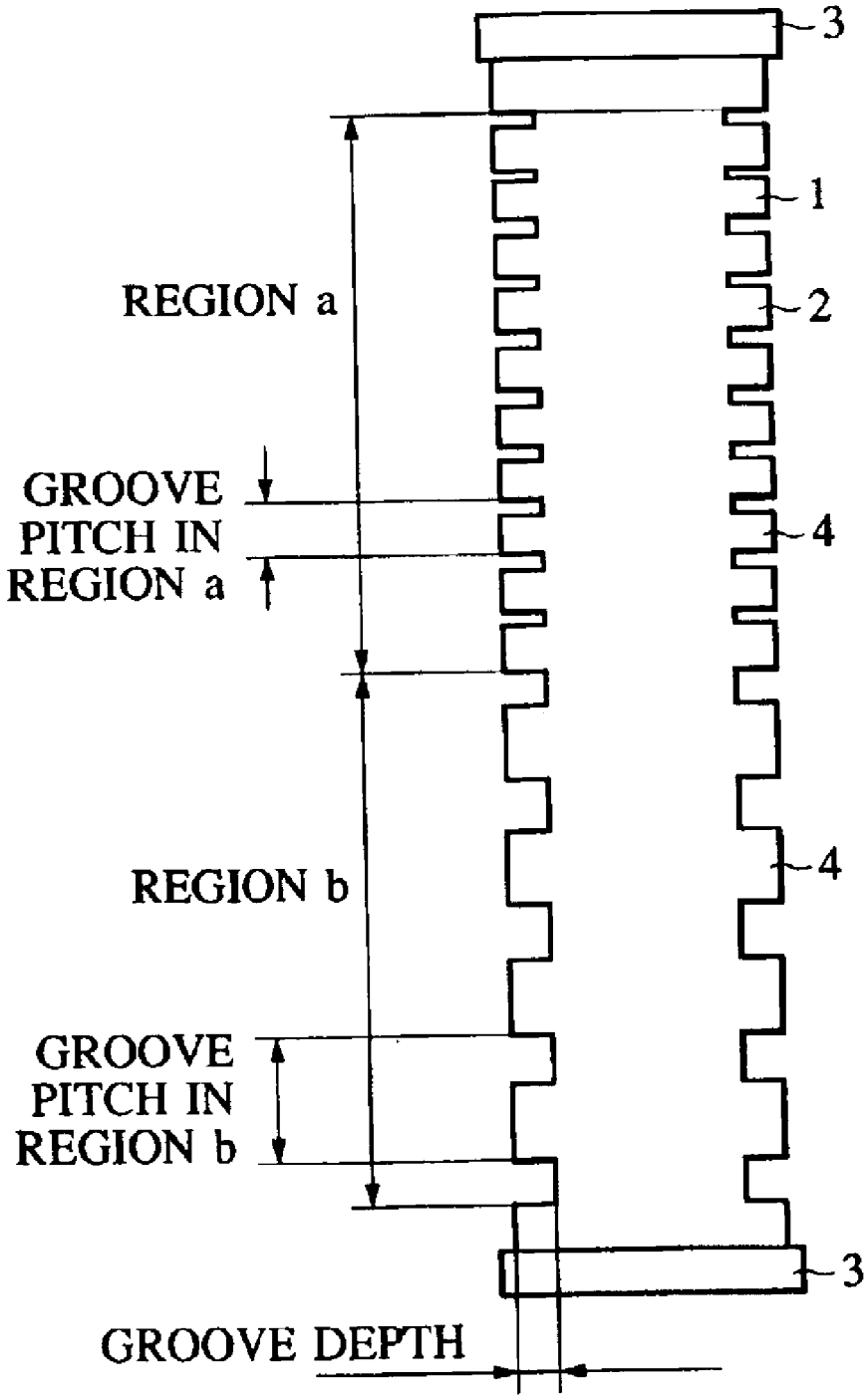
FIG. 3 is a sectional view of the structure of a spacer used in an electron beam apparatus in accordance with one embodiment of the present invention.

FIG. 3 is a sectional view illustrating the structure of the spacer for use in the electron beam apparatus of example 1 of the embodiment. As shown, the spacer includes a spacer substrate 1, high-resistance resistive film 2 deposited on the surface of the spacer, spacer electrodes 3, and ruggedized portion 4 formed on the spacer having grooves. The surface of the spacer was segmented into regions a and b, different from each other in the pitch and depth of the grooves. The dielectric component 401 (see FIG. 4) was produced by heating a glass base having already grooves thereon, and extending the glass base in the softened state thereof to a similarly shrunk form. In this modification, the glass base was a 2.8 mm thick glass base PD-200 (manufactured by ASAHI GLASS Co., LTD) having low alkali content. The glass base was shrunk to 1/24 of the original size of the dielectric component 401 having the grooves as shown in FIG. 3. An $SiO_2$ layer was applied and calcined to a thickness of 100 nm on the dielectric component 401 as a sodium blocking layer.

As already discussed, tungsten (W) and germanium (Ge) were sputtered to the dielectric component 401 in a nitrogen atmosphere as high-resistance resistive films 404*a* and 404*b*. In example 1, the pitch of the grooves in the region a on the side of the faceplate 402 was 20 $\mu$m, and the pitch of the grooves in the region b on the side of the rear plate 403 was 100 $\mu$m. The widths of the region a and the region b were equal to each other. The regions were different in the average pitch and the average depth of the grooves, but it is perfectly acceptable that the regions are different from each other in one of the average pitch and the average depth of the grooves.

In the image display apparatus of example 1, the spacing between the electron emitters 407*a* and 407*b* in cross section (in a horizontal direction on the page of FIG. 4) was 615 $\mu$m, and the length of the spacer was 1.6 mm. When the image display apparatus (panel) was actually operated, an excellent image was presented with no electron beam attracted in position toward the spacer.

EXAMPLE 2

Example 2 of the embodiment will now be discussed. In example 2, the spacer used in the image display apparatus is modified.

Figure 14:
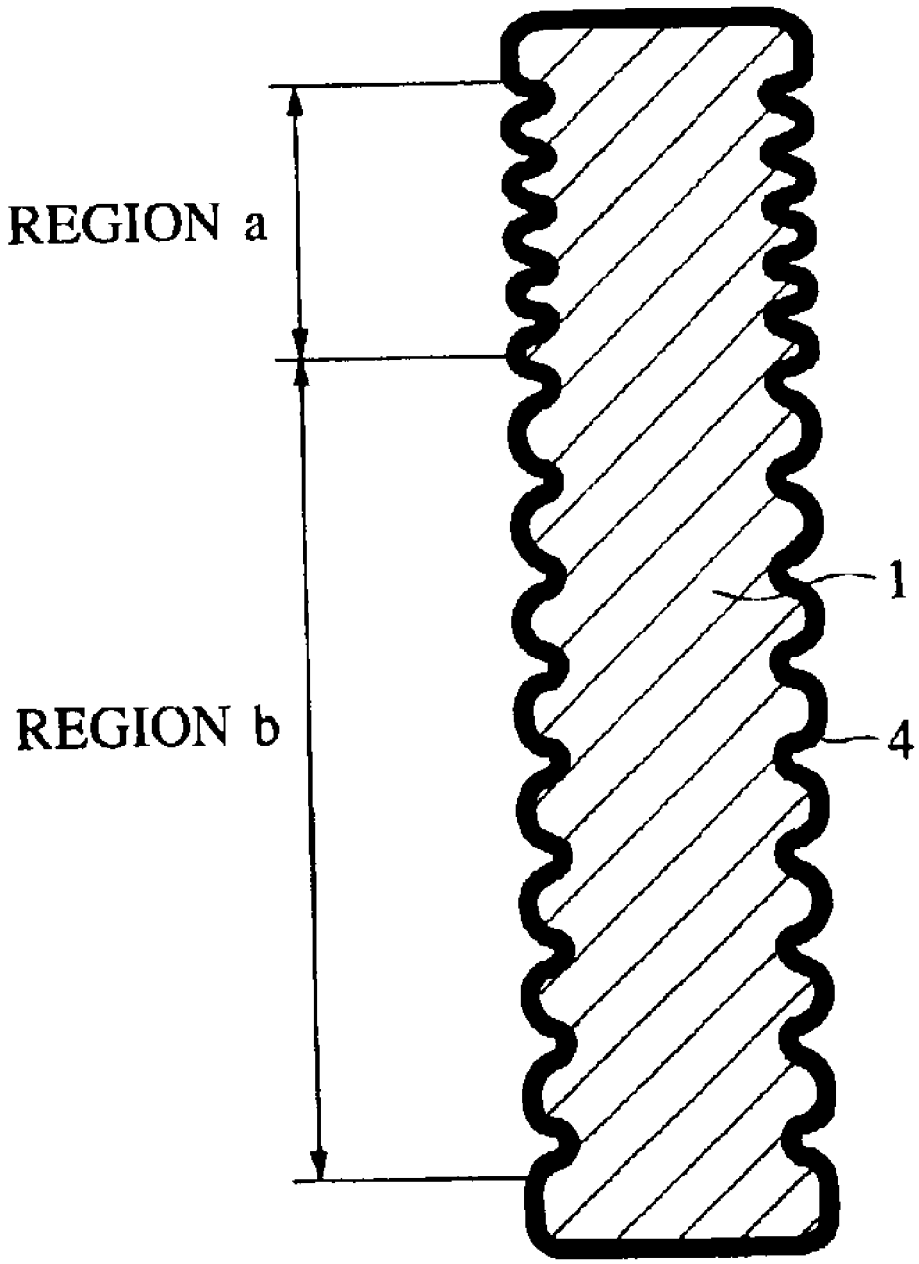
FIG. 14 is a sectional view of the spacer in accordance with example 2 of the embodiment of the present invention.

FIG. 14 is a sectional view of the spacer in accordance with example 2 of the embodiment of the present invention. As shown, the spacer includes a spacer substrate (dielectric component) 1, and a ruggedized portion 4 formed on the spacer substrate 1.

As in example 1, the spacer was segmented into regions a and b. Example 2 is different from example 1 in that the width ratio of the region a to the region b is 1:3. The pitch of the grooves in the region a was 20 μm, and the pitch of the grooves in the region b was 80 μm. The depth of the grooves in both the region a and the region b was 11 μm. The length of the spacer was 1.6 mm.

In the spacer of example 2, the average pitch of the grooves on the spacer from a half-way point up to the face plate was smaller than the average pitch of the grooves on the spacer from the half-way point down to the rear plate. Since the average pitch of the grooves in the region a was smaller than the average pitch of the grooves in the region b, the number of grooves formed on the spacer from the half-way point up to the faceplate was larger than the number of grooves formed on the spacer from the half-way point down to the rear plate.

As in example 1, a large glass base having already grooves thereon was heated, and was extended in the softened state thereof to a similarly shrunk size. As in example 1, the spacer in example 2 was coated with a high-resistance resistive film. The resistive film was deposited using a sputtering device. The sputtering device formed high-resistance resistive film using tungsten (W) and germanium (Ge) as a target in a mixture gas containing argon (Ar) and nitrogen ($N_2$) at a flow rate of argon to nitrogen of 7:3 at a sputtering pressure of 1.0 Pa. The substrate was spaced from the targets by about 100 mm, an input power to the tungsten target was 0.55 W/cm$^2$, and an input power to the germanium target was 2 W/cm$^2$. A resulting thickness of the film was 200 nm.

The spacer of example 2 was used in the image display apparatus of the embodiment. No electrons were attracted in the vicinity of the spacer because of the beam repellent and attractive effect caused by the sheet resistance distribution on the surface of the spacer adjusted by the ruggedized configuration of the spacer. An excellent image was thus obtained.

EXAMPLE 3

Figure 1:
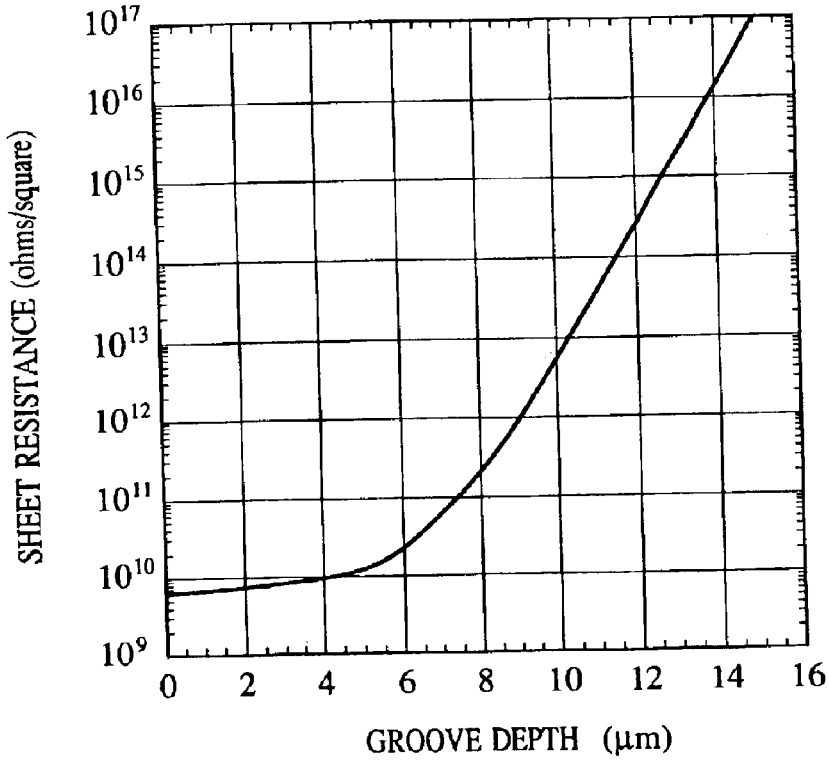
FIG. 1 is a plot of a sheet resistance versus the depth of a groove.
Figure 2:
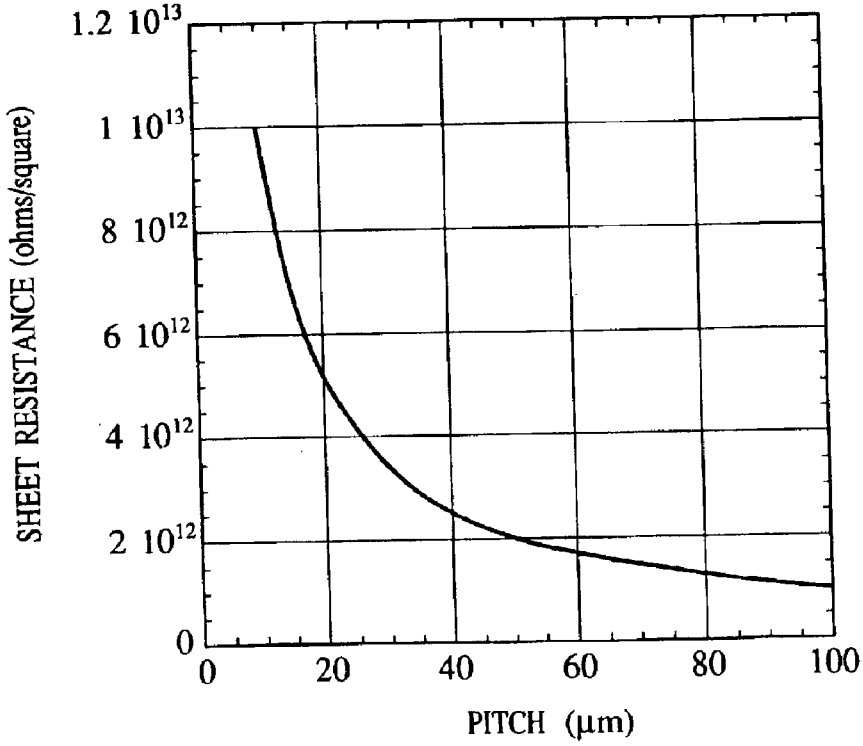
FIG. 2 is a plot of a sheet resistance versus the pitch of the groove.
Figure 15:
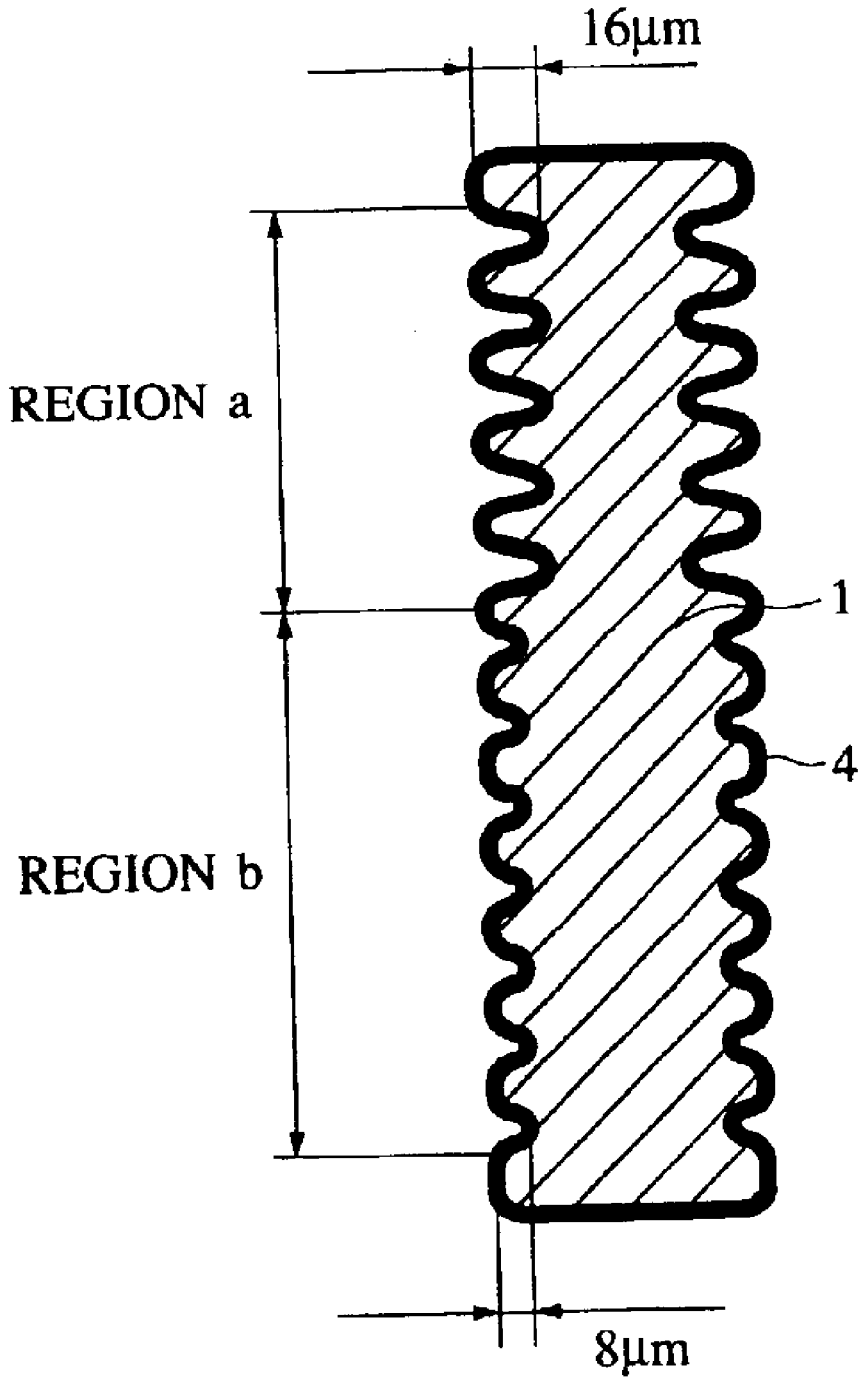
FIG. 15 is a sectional view of the spacer in accordance with example 3 of the embodiment of the present invention.

Example 3 of the embodiment of the present invention will now be discussed. FIG. 15 is a sectional view of the spacer in accordance with example 3 of the embodiment. The spacer of example 3 corrects the electron beam position by changing the depth of a ruggedized portion 4 from region a to region b. As seen from FIGS. 1 and 2, the method of changing the depth changes the sheet resistance more than the method of changing the pitch of the grooves.

Referring to FIG. 15, the spacer of example 3 includes a spacer substrate 1, and a ruggedized portion 4 formed on the spacer substrate 1. The grooves in the ruggedized portion 4 in a region a were as deep as 16 μm. The grooves in ruggedized portion 4 in a region b were as deep as 8 μm. In the spacer of example 3, the average depth of the grooves formed on the spacer from a half-way point up to the faceplate was larger than the average depth of the grooves formed on the spacer from the half-way point down to the rear plate.

In example 3, the length ratio of the region a to the region b was 5:7, and the length of the spacer was 1.6 mm. A base was molded into the spacer substrate 1 having a ruggedized portion with grooves, and extended under heating.

The spacer of example 3 was coated with the high-resistance resistive film as in example 1 and was then used in the image display apparatus. An excellent image was presented with almost no beam position deviation occurring in the vicinity of the spacer.

EXAMPLE 4

Figure 16:
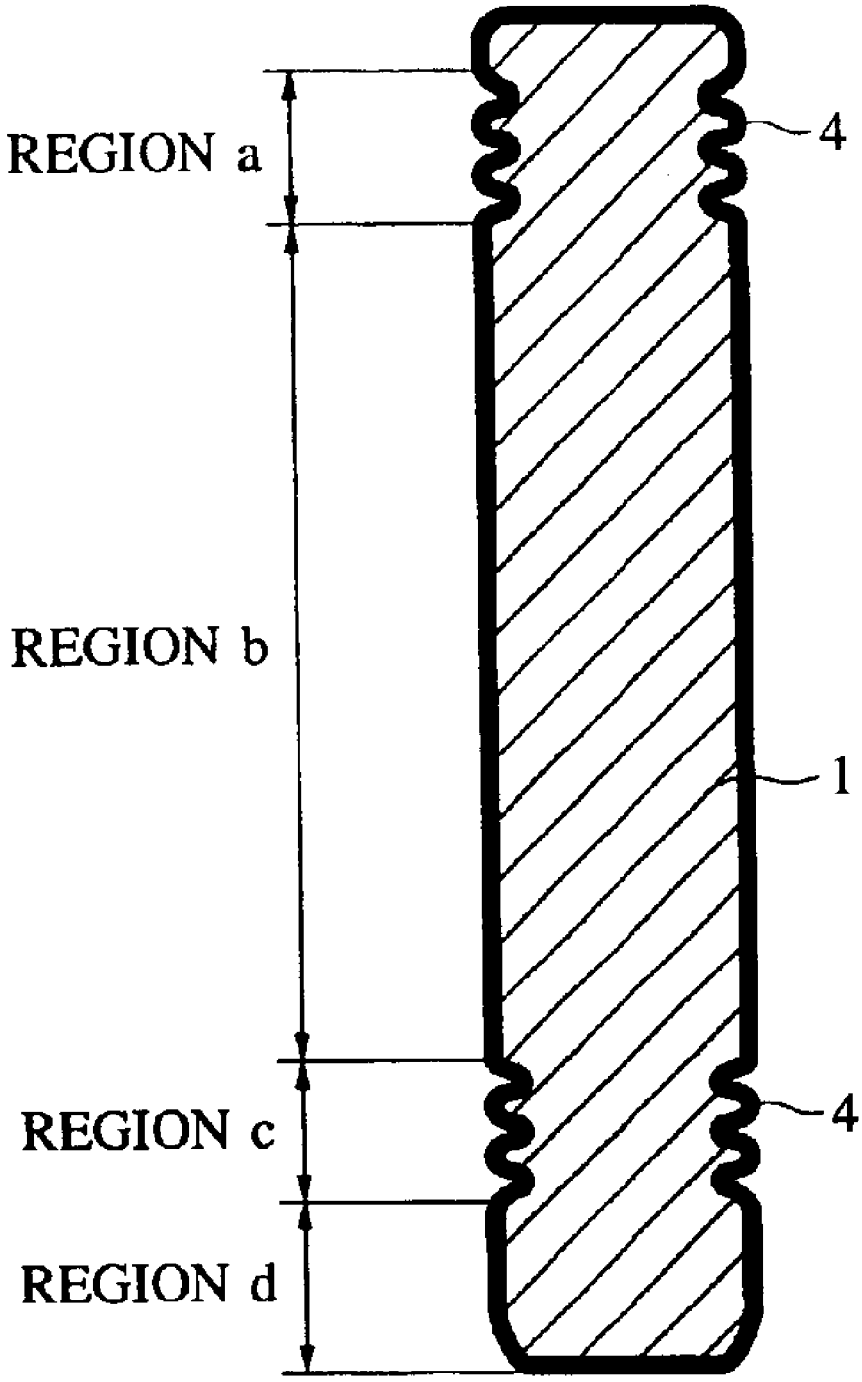
FIG. 16 is a sectional view of the spacer in accordance with example 4 of the embodiment of the present invention.

Example 4 of the embodiment of the present invention is discussed. FIG. 16 is a sectional view of the spacer in accordance with example 4 of the embodiment of the present invention. In example 4, the number of segmentations is adjusted to correct a beam deviation.

Referring to FIG. 16, the spacer of example 4 includes a spacer substrate 1 including a ruggedized portion 4 with grooves. Regions a and c had grooves, and the depth of the grooves was 16 μm. Regions b and d were flat portions having no grooves formed thereon.

In the spacer of example 4, the ratio of length of the region a and the region c was 1:1 (with the length thereof equal to 180 μm). The ruggedized portion 4 having the grooves at a pitch of 80 μm was formed in each of the regions a and c. The region d was 160 μm. The length of the spacer was 1.6 mm. By increasing the length of the region d, an electric field generated in the vicinity of the spacer near the electron emitter repelled electrons in the trajectory thereof.

As in example 1, a large glass base having already grooves thereon was heated, and was extended in the softened state thereof to a similarly shrunk size. Since the area of the glass base to be processed is small, the production yield of the spacer is high.

Similar to the spacer of example 1, the spacer of example 4 was also used in the image display apparatus of the embodiment of the present invention. No electrons were attracted in the vicinity of the spacer because of the beam repellent and attractive effect caused by the sheet resistance distribution on the surface of the spacer adjusted by the ruggedized configuration of the spacer. An excellent image was thus obtained.

EXAMPLE 5

Figure 17:
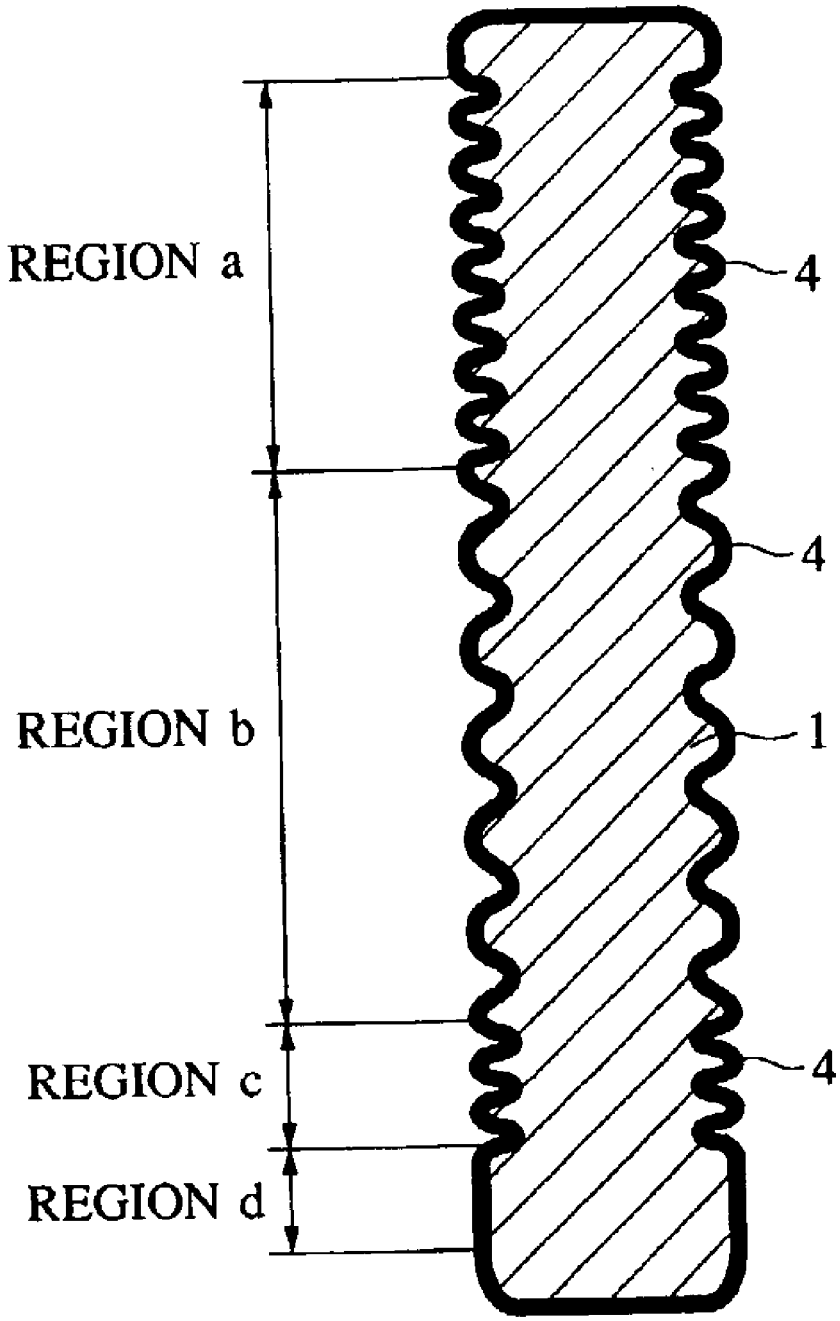
FIG. 17 is a sectional view of the spacer in accordance with example 5 of the embodiment of the present invention.

Example 5 of the embodiment of the present invention is discussed below. FIG. 17 is a sectional view of the spacer in accordance with example 5 of the embodiment of the present invention. The spacer of example 5 was produced by forming grooves on the flat portion of the spacer of example 4, thereby reducing more static charge accumulation.

Referring to FIG. 17, the spacer 1 includes a spacer substrate 1 having ruggedized portions 4. Regions a through c were ruggedized portions. The depth of the grooves in the regions a and c was 16 μm, and the depth of the grooves in the region b was 10 μm. As in example 4, the spacer had a flat portion in the region d.

The spacer of example 4 was coated with the high-resistance resistive film as in example 1 and was then used in the image display apparatus. An excellent image was presented with almost no beam position deviation occurring in the vicinity of the spacer.

The electron beam apparatus containing each of the spacers of examples 1 through 5 is used as the image-forming apparatus in the above discussion. In the image-forming apparatus, each electrode works as an acceleration electrode to accelerate electrons emitted from the electron source. The image-forming apparatus irradiates a target with the electrons emitted from the cold cathode in response to an input signal, thereby presenting an image on a screen. The target is a fluorescent film. The cold cathode is a device composed of the pair of electrodes and the electrically conductive film including an electron emitter interposed therebetween, and is preferably a surface-conduction type electron emitter device. The electron source is a passive-matrix electron source which includes a plurality of cold cathodes arranged in a matrix with a plurality of lines in the row direction and a plurality of lines in the column direction. In the electron source, a plurality of lines in the row direction are arranged, each being connected to each row of a plurality of rows of cold cathodes, and control electrodes (also called grids), respectively arranged above the cold cathodes, run in the column direction.

The application of the electron beam apparatus employing the spacer of the present invention is not limited to the image-forming apparatus. The electron beam apparatus of the present invention may serve as an alternative that is substituted for a light emitting diode in an optical printer which includes a photosensitive drum and the light emitting diode.

By appropriately selecting m lines in the row direction and n lines in the column direction, not only a line optical source but also a two-dimensional optical source may be embodied. An image-forming member (the faceplate) is not limited to the above-referenced fluorescent material that directly emits light. A material that forms a latent image in accordance with static charge accumulation may also be used.

For example, the present invention may be applied to an electron microscope which uses a target, to which electrons emitted from an electron source is directed, is other than an image-forming member such as a fluorescent film. The target is not limited to any particular material in the electron beam apparatus of the present invention.

In the electron beam apparatus and the spacer of the present invention, the grooves in the ruggedized portion in the spacer extend in substantial parallel with the rear plate and the faceplate. The equipotential lines in the space between the rear plate and the faceplate run substantially parallel with the faceplate and the rear plate. The potential is thus uniformly defined in the space, and the electron trajectory is free from disturbance due to the presence of the spacer.

By modifying at least one of the depth and pitch of the grooves from region to region on the surface of the spacer, the spacer has a desired resistance distribution on the surface thereof. The use of such a spacer corrects the electron beams to a desired trajectory.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising a first substrate, a second substrate, and a spacer that defines a spacing between said first substrate and said second substrate, wherein said spacer comprises a portion ruggedized with grooves on a surface thereof exposed in a space between said first substrate and said second substrate, said grooves extending in a striped fashion substantially parallel with said first substrate and said second substrate, wherein said ruggedized portion comprises a plurality of regions, which are different from each other, in a ruggedized configuration, and said plurality of regions are different from each other in an average pitch of said grooves, and wherein the average pitch of said grooves formed on said spacer from a half-way point up to said second substrate is smaller than the average pitch of said grooves formed on said spacer from the half-way point down to said first substrate.

2. The image-forming apparatus according to claim 1, wherein said surface of said spacer has a region having no ruggedness.

3. The image-forming apparatus according to claim 1, wherein a resistive film having a specific resistance falling within a range of $10^4$ Ω·cm to $10^{10}$ Ω·cm is formed on said surface of said spacer.

4. The image-forming apparatus according to claim 3, further comprising an electrode arranged on said spacer to electrically connect said resistive film to said first substrate.

5. The image-forming apparatus according to claim 3, further comprising an electrode arranged on said spacer to electrically connect said resistive film to said second substrate.

6. The image-forming apparatus according to claim 1, further comprising an electron emitter arranged on said first substrate, and an image-forming member, arranged on said second substrate, for forming an image when being irradiated with electrons emitted from said electron emitter.

7. An image-forming apparatus comprising a first substrate, a second substrate, and a spacer that defines a spacing between said first substrate and said second substrate, wherein said spacer comprises a portion ruggedized with grooves on a surface thereof exposed in a space between said first substrate and said second substrate, said grooves extending in a striped fashion substantially parallel with said first substrate and said second substrate, wherein said ruggedized portion comprises a plurality of regions, which are different from each other, in a ruggedized configuration, and said plurality of regions are different from each other in an average depth of said grooves, and wherein the average depth of said grooves formed on said spacer from a half-way point up to said second substrate is larger than the average depth of said grooves formed on said spacer from the half-point down to said first substrate.

8. The image-forming apparatus according to claim 7, further comprising an electron emitter arranged on said first substrate, and an image-forming member, arranged on said second substrate, for forming an image when being irradiated with electrons emitted from said electron emitter.

9. The image-forming apparatus according to claim 7, wherein said surface of said spacer has a region having no ruggedness.

10. The image-forming apparatus according to claim 7, wherein a resistive film having a specific resistance falling within a range of $10^4$ Ω·cm to $10^{10}$ Ω·cm is formed on said surface of said spacer.

11. The image-forming apparatus according to claim 10, further comprising an electrode arranged on said spacer to electrically connect said resistive film to said first substrate.

12. The image-forming apparatus according to claim 10, further comprising an electrode arranged on said spacer to electrically connect said resistive film to said second substrate.

13. An image-forming apparatus comprising a first substrate, a second substrate, and a spacer that defines a spacing between said first substrate and said second substrate, wherein said spacer comprises a portion ruggedized with grooves on a surface thereof exposed in a space between said first substrate and said second substrate, said grooves extending in a striped fashion substantially parallel with said first substrate and said second substrate, wherein said ruggedized portion comprises a plurality of regions, which are different from each other, in a ruggedized configuration, and wherein a number of said grooves formed on said spacer from a half-way point up to said second substrate is greater than a number of said grooves formed on said spacer from the half-way point down to said first substrate.

14. The image-forming apparatus according to claim 13, further comprising an electron emitter arranged on said first substrate, and an image-forming member, arranged on said second substrate, for forming an image when being irradiated with electrons emitted from said electron emitter.

15. The image-forming apparatus according to claim 13, wherein said surface of said spacer has a region having no ruggedness.

16. The image-forming apparatus according to claim 13, wherein a resistive film having a specific resistance falling within a range of $10^4$ Ω·cm to $10^{10}$ Ω·cm is formed on said surface of said spacer.

17. The image-forming apparatus according to claim 16, further comprising an electrode arranged on said spacer to electrically connect said resistive film to said first substrate.

18. The image-forming apparatus according to claim 16, further comprising an electrode arranged on said spacer to electrically connect said resistive film to said second substrate.

* * * * *

UNITED STATES PATENT AND TRADEMARK OFFICE

CERTIFICATE OF CORRECTION

PATENT NO. : 6,963,159 B2
DATED : November 8, 2005
INVENTOR(S) : Masahiro Fushimi It is certified that error appears in the above-identified patent and that said Letters Patent is hereby corrected as shown below:

Column 16,
Line 54, "half-point" should read -- half-way point --.

Signed and Sealed this

Eighteenth Day of April, 2006

JON W. DUDAS
*Director of the United States Patent and Trademark Office*